United States Patent [19]

Lin

[11] Patent Number: 4,905,382

[45] **Date of Patent: * Mar. 6, 1990**

[54] CUSTOM MIDSOLE

[75] Inventor: Yung-Mao Lin, Taichung, China

[73] Assignee: Autry Industries, Inc., Dallas, Tex.

[ * ] Notice: The portion of the term of this patent subsequent to Mar. 29, 2005 has been disclaimed.

[21] Appl. No.: 153,222

[22] Filed: Feb. 8, 1988

Related U.S. Application Data

[60] Continuation-in-part of Ser. No. 25,010, Mar. 12, 1987, Pat. No. 4,733,483, and a continuation-in-part of Ser. No. 97,806, Sep. 17, 1987, abandoned, which is a division of Ser. No. 25,010.

[51] Int. Cl.[4] ..... A43B 13/14; A43B 13/18; A43B 13/36

[52] U.S. Cl. ..... 36/28; 36/30 R; 36/32 R; 36/107

[58] Field of Search ..... 36/28, 29, 43, 44, 3 R, 36/3 B, 14, 114, 30 R, 32 R, 15, 100, 101, 107

[56] References Cited

U.S. PATENT DOCUMENTS

| | | | |
|---|---|---|---|
| 74,912 | 2/1868 | Hadley | 36/43 |
| 128,055 | 6/1872 | McIlhenney | 36/44 |
| D. 199,300 | 10/1964 | Martin | D2/318 |
| D. 236,562 | 9/1975 | Wunsch et al. | D2/318 |
| 945,698 | 1/1910 | Conway | 36/44 |
| 1,540,430 | 6/1925 | Sims | 36/44 |
| 1,559,532 | 10/1925 | Smith | 36/28 |
| 2,090,881 | 4/1936 | Wilson | 36/29 |
| 2,146,888 | 2/1939 | Fisch | 36/44 |
| 2,405,224 | 8/1946 | Margolin | 36/30 R |
| 2,546,296 | 3/1951 | Braun | 36/30 A |
| 2,721,400 | 10/1955 | Israel | 36/28 X |
| 3,426,455 | 2/1969 | Drago | 36/3 B |
| 3,589,037 | 6/1971 | Gallagher | 36/44 |
| 4,045,886 | 9/1977 | Terasaki | 36/44 |
| 4,075,772 | 2/1978 | Sicurella | 36/43 |
| 4,095,353 | 6/1978 | Foldes | 36/11.5 |
| 4,103,440 | 8/1978 | Lawrence | 36/101 |
| 4,187,620 | 2/1980 | Selner | 36/28 |
| 4,215,492 | 8/1980 | Sandmeier | 36/44 |
| 4,271,607 | 6/1981 | Funck | 36/30 R |
| 4,297,796 | 11/1981 | Stirtz et al. | 36/28 |
| 4,319,412 | 3/1982 | Muller et al. | 36/29 |
| 4,481,726 | 11/1984 | Phillips | 36/30 R |
| 4,509,510 | 4/1985 | Hook | 36/44 X |
| 4,551,930 | 11/1985 | Graham et al. | 36/30 R |
| 4,598,484 | 7/1986 | Ma | 36/3 R |
| 4,676,010 | 6/1987 | Cheskin | 36/32 R |
| 4,733,483 | 3/1988 | Lin | 36/28 |

FOREIGN PATENT DOCUMENTS

| | | | |
|---|---|---|---|
| 0215995 | 4/1987 | European Pat. Off. | 36/29 |
| 3228017 | 7/1983 | Fed. Rep. of Germany | 36/3 R |
| 3347343 | 7/1985 | Fed. Rep. of Germany | 36/114 |
| 2250266 | 5/1975 | France | 36/30 R |
| 2573633 | 5/1986 | France | 36/44 |
| 2009726 | 6/1983 | German Democratic Rep. | 36/43 |
| 59-168802 | 9/1984 | Japan | 36/25 R |
| 2159038 | 11/1905 | United Kingdom | 36/101 |
| 643119 | 9/1950 | United Kingdom | 36/14 |
| 2007081 | 5/1979 | United Kingdom | 36/32 R |
| 2114869 | 9/1983 | United Kingdom | 36/114 |

*Primary Examiner*—James Kee Chi
*Attorney, Agent, or Firm*—Baker, Mills & Glast

[57] ABSTRACT

A midsole (10 and 22) for an activewear shoe (12) comprises a removable insert (10) and a peripheral member (22). The peripheral member (22) is joined to the perimeter of an upper surface (18) of an outsole (14) to form a receptable (28). A reinforcing layer (31) substantially less thick than the peripheral member (22) is joined to the outsole upper surface (18) within the receptable (28). A plurality of independent cushioning elements (34) depend from a base member (32) of insert (10), and are sized in order to conform to the lift of peripheral member (22). The cushionability and resiliency of insert (10) may be selected according to the wearer's weight and cushionability preference.

13 Claims, 3 Drawing Sheets

CUSTOM MIDSOLE

RELATED APPLICATION

This application is a continuation-in-part of co-pending U.S. application Ser. No. 025,010 filed Mar. 12, 1987, now U.S. Pat. No. 4,733,483, issued on Mar. 29, 1988, and a continuation-in-part of Ser. No. 097,806, now abandoned, which is also a division of Ser. No. 025,010.

TECHNICAL FIELD OF THE INVENTION

This invention relates in general to athletic or other activewear shoes, and more particularly relates to shoes having custom midsoles.

BACKGROUND OF THE INVENTION

Athletic or other activewear shoes of a conventional construction generally have three or four separate parts. First, such shoes are provided with an outsole that is made of a durable material and that extends across the lower surface of the shoe. A midsole is joined to the outsole to provide a cushioning layer to the wearer's foot. Usually, an upper formed of leather, synthetics or other materials is joined to the midsole. In many conventional structures, an insole is further provided for disposal between the midsole and the wearer's foot for additional cushioning.

The midsoles of these conventional constructions have two undesirable characteristics. First, they have the property of deforming over a large area of surface when a downward force is impressed on them. Second, the midsoles are affixed to the shoes and therefore customers can make no choice in the midsole's cushionability without selecting another shoe. Thus, conventional midsoles do not offer anything in the way of independent suspension or deformation of various areas thereof, and further are suited to only a particular weight class or cushionability preference of wearers.

Thus, a need has arisen for a midsole that has a plurality of cushioning elements, each demonstrating an individual suspension and deforming independently from the remaining elements. Further, a need exists for midsoles that can be selected according to the weight or cushionability preference of the wearer.

SUMMARY OF THE INVENTION

The present invention comprises a shoe having an outsole with an upper surface. A peripheral portion of a midsole is joined to the upper surface, and further forms a receptacle for the insertion of an insert. The peripheral portion and the insert are formed of a cushionable material. The insert is preferably formed to be laterally coextensive with the area on which most of the weight of the wearer's foot is received. The insert has a preselected cushionability that is selected according to the wearer's weight or cushionability preference. The selected insert is inserted into the receptacle, thus providing a custom midsole that is optimum for the customer's weight or cushioning preferences. An upper is joined to the peripheral portion of the midsole.

Another aspect of the invention comprises a midsole having an insert and a peripheral member disposed laterally outwardly of the insert. The insert has a lower surface with a plurality of convex cushioning elements formed to substantially fill at least a major portion of the insert lower surface. The elements are each operable to cushionably and independently deform responsive to downward force thereon. In a preferred embodiment, the upper surface of the midsole is joined to a fabric layer, which can be constructed out of a flocking material, such as can be made out of polyester and nylon.

In another aspect of the invention, the insert can be integrally formed with an insole member, the insole surface extending laterally over the peripheral member of the midsole.

In another embodiment of the invention, the insert has a plurality of convex elements formed in its upper surface as well as its lower surface. The convex elements are preferably in registry with respective lower elements.

According to a further aspect of the invention, the insert of the midsole is selected from a plurality of like inserts, each having a different durometer reading that is related to the member's cushionability. Thus, an insert can be selected by the customer that is optimum for his or her weight or cushioning preference.

Preferably, a footbed reinforcing layer is offered to the bottom of the receptacle prior to placing the insert therein. The footbed reinforcing layer is preferably much thinner than the depth of the receptacle and provides torsional strength for lateral support of the wearer's foot.

BRIEF DESCRIPTION OF THE DRAWINGS

Various aspects of the invention and their advantages will be more completely understood by reference to the following Detailed Description in conjunction with the appended drawings in which.

DETAILED DESCRIPTION

Figure 1:
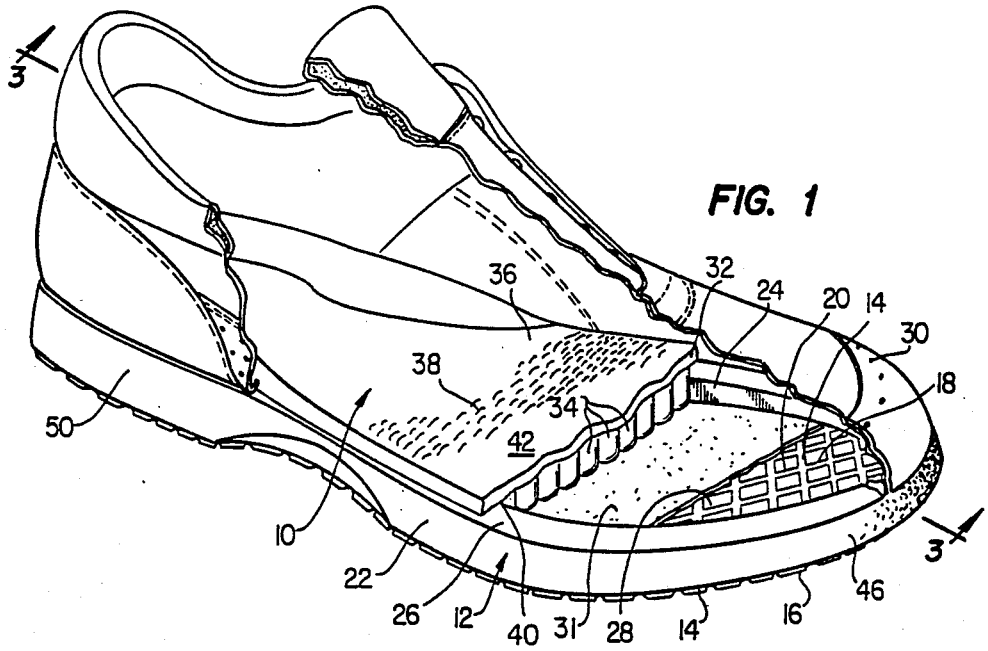
FIG. 1 is an isometric view of a shoe construction according to the invention as fitted with a custom midsole therefor, with parts broken away to show interior structure.

Referring first to FIG. 1, an isometric view of a preferred embodiment of a shoe construction according to the invention is shown. A custom midsole insert is indicated generally at 10. Insert 10 is shown as fitted into an active wear shoe indicated generally at 12. While the illustrated shoe 12 is one designed for walking, the invention can also be employed in other types of athletic shoes, such as running, aerobics, or court shoes. The invention also has application in any circumstance where varying midsole cushionability is desired.

Shoe 12 is comprised of an outsole 14 that forms the wearing surface of the shoe. Outsole 14 is preferably constructed of a relatively durable, resilient material such as natural rubber. Outsole 14 has an exterior surface that is provided with a suitable tread surface 16. Outsole 14 further has an interior or upper surface 18. Upper surface 18 may be smooth and featureless throughout, or may have a central area 20 that is reticulated or webbed in order to save weight. A peripheral area (not shown) of upper surface 18 presents a smooth surface for gluing or other means of attachment.

A peripheral midsole member 22 is formed to be glued or otherwise attached to the peripheral area of outsole upper surface 18. Peripheral member 22 is more cushionable and yieldable than outsole 14, and can be conveniently molded of polyurethane foam or ethylene vinyl acetate copolymer (EVA). Peripheral member 22 is in the illustrated embodiment endless and extends completely around the periphery of outsole 14. Peripheral member has an interior sidewall 24 and an upper surface 26. Member 22 defines a central receptacle 28 that is dimensioned for receiving insert 10.

While in the illustrated embodiment peripheral member 22 is endless, this need not necessarily be the case. Member 22 can, for example, take the form of two longitudinal strips, one for each side of the shoe, or could take the form of several sections spaced around the periphery of the shoe. The form taken by peripheral member 22 should in any event perform its dual function of retaining insert 10 and provide structural support for the peripheral area of the shoe.

Preferably, a footbed reinforcing layer 31 is affixed as by gluing to outsole upper surface 18 within receptacle 28. Layer 31 is preferably much thinner than the depth of central receptacle 28 so as to allow room for insert 10. Reinforcing layer 31 is sized to substantially coincide with the bottom area of receptacle 28.

Layer 31 is fabricated of a relatively resilient firm and less flexible material in relation to the EVA forming peripheral member 22. For example, layer 31 can be constructed of a leatherized paper or cardboard. The purpose of layer 31 is to replace torsional strength lost by the creation of receptable 28 in midsole member 22. Thus, a midsole/outsole configuration having satisfactory torsional strength is formed for proper lateral support of the wearer's foot while at the same time providing for a central insert 10 having selectable cushionability.

Shoe 12 further comprises an upper 30 that can be fashioned of leather, cloth, synthetic materials or a combination of these, and is attached to upper surface 26 of peripheral member 22 by a method later described.

Insert 10 comprises an upper base member 32 and a plurality of supporting elements 34 that are preferably formed integrally with base member 32 to depend therefrom. As shown, elements 34 occupy receptacle 28 when central member or element 10 is inserted into shoe 12. Elements 34 are dimensioned such that their depth matches the depth of sidewall 24 minus the thickness of layer 31, and are formed so as to occupy substantially all of receptacle 28 from one sidewall 24 to the other. Peripheral member 22 and removable insert 10 are apportioned such that most of the weight of the wearer will be borne by insert 10.

Base member 32 has an upper surface 36. A flocking material 38, which is preferably formed of a polyester/-nylon material but can be formed of any suitable fabric, is joined as by gluing to upper surface 36. As finished out by flocking material 38, insert 10 would not require any insole or liner on top of it to be suitable for wearing.

As shown, base member 32 has a central member 42, and a lip member 40 that extends beyond central area 42. Cushioning elements 34 depend from central member 42. Lip member 40 is formed to be coextensive with top surface 26 of peripheral member 22. A uniform cushionable upper surface 36 is therefore presented to the wearer's foot throughout the interior of the shoe.

Figure 2:
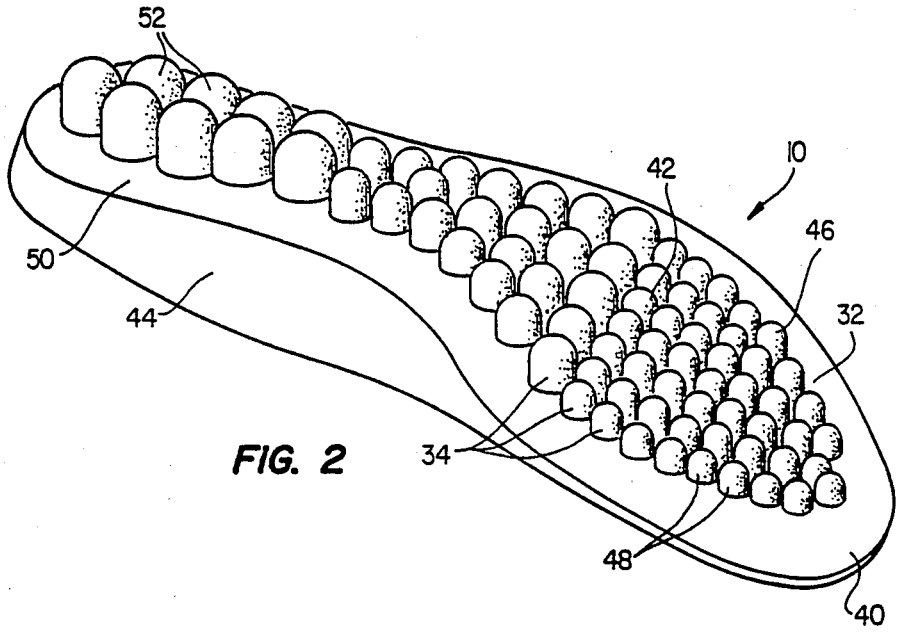
FIG. 2 is a bottom isometric view of a preferred embodiment of a custom midsole insert of the invention.

Referring now to FIG. 2, a bottom isometric view of insert 10 is shown. In the illustrated embodiment, insert 10 is integrally formed with an insole portion 44. In the embodiment shown in FIG. 2, upper surface 36 comprises the upper surface of insole portion 44, and the flocking material 38 (FIG. 1) is joined to this surface.

In the embodiment illustrated in FIGS. 1 and 2, elements 34 each take the form of a pillar with a rounded free end. Elements 34 are formed in central area 42 in a closest packing arrangement in order to provide cushionable support throughout central area 42. Elements 34 are formed independently of each other, and are only joined to base 32. In this manner, elements 34 provide in effect a multiple-point independent suspension. This is because elements 34 will be compressed and will yield independently of each other. This is an advantage over midsoles or insoles of solid construction, which have a tendency to yield and compress continuously and uniformly over large areas. The discrete elements 34 on the other hand given an independent, discontinuous support to different portions of the foot that is not obtainable by a midsole or insole of uniform construction.

Elements 34 are graduated in size in order to conform to the depth of sidewall 24 (FIG. 1). In a front area 46 of area 42, a plurality of relatively small elements 48 and formed. Elements 48 will conform to the relatively thin depth of peripheral member 22 in the front region. In heel region 50, a relatively small number of large heel cushioning elements 52 are formed. The larger size of elements 52 adapts them to the larger depth of peripheral member 22 in heel region 50. Further, since there is a larger cushioning depth of material, the larger size of elements 52 prevents undue bending or nonradial deformation, as might otherwise occur if a plurality of long, thin elements were used.

Figure 3:
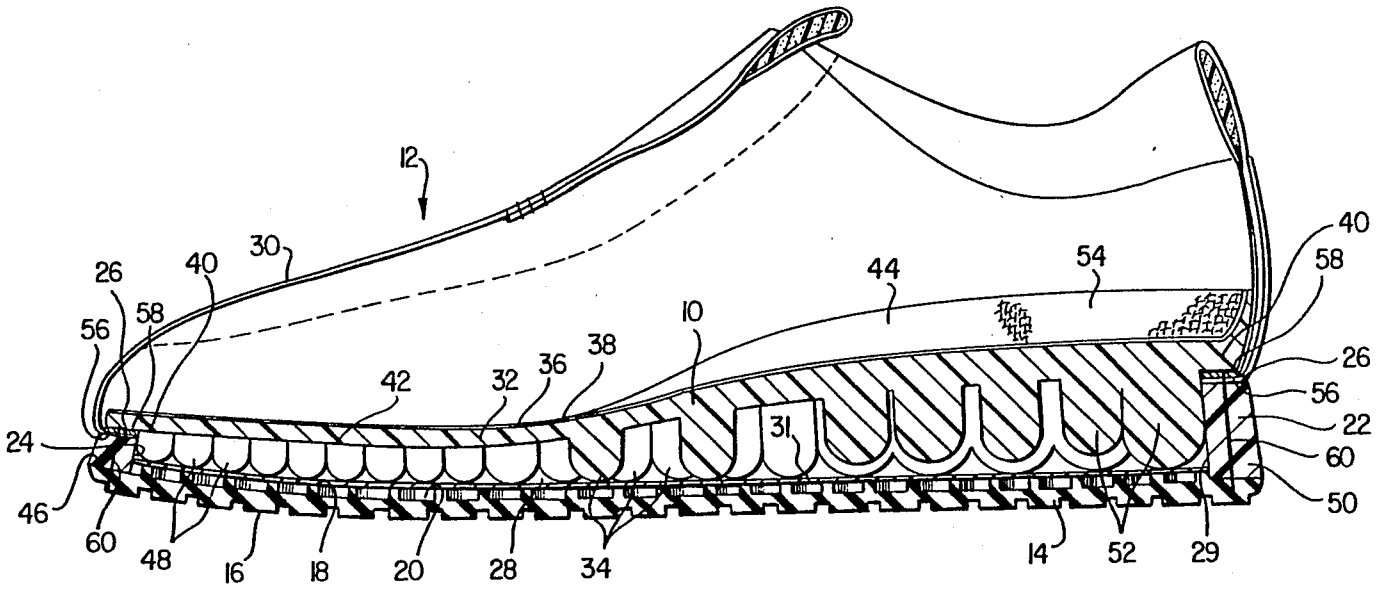
FIG. 3 is a longitudinal section taken substantially along line 3—3 of FIG. 1.

Referring now to FIG. 3, an elevational section taken substantially along line 3—3 of FIG. 1 is shown. FIG. 3 particularly illustrates the graduated size of elements 34 from front region 46 to rear region 50. Some of the elements 34 are not shown in section because section line 3—3 did not pass through them, or are shown only partially in section because line 3—3 did not pass through them along their major diameter. Insole portion 44 is shown to have a concave surface 54 in heel region 50 for the support of the heel of the wearer's foot.

Upper 30 has a bottom lip member 56 for mating with upper surface 26 of peripheral member 22. Lip member 56 is attached as by gluing to upper surface 26. Then, an element 58 is placed on top of lip member 56. Element 58 is elongated and extends around the periphery of shoe 12, corresponding to upper surface 26. Element 58 can conveniently be formed of the leatherized paper material preferably forming reinforcing layer 31, or from another relatively strong material. Stitching 60 is used to join element 58, lip member 56 and peripheral member 22, and optionally outsole 14, together.

In operation, shoes 12 and inserts 10 are distributed to retailers as separate items, Each insert 10 has a specific durometer reading that measures its relative yieldability or resiliency. The cushionability of inserts 10 can also be varied by changing the shape and/or spacing of elements 34. A plurality of different inserts 10 having a range of durometer readings are provided for each shoe size, such that any pair of numerous pairs of inserts 10 can be inserted into a respective pair of shoes 12. A particular pair of inserts 10 are selected for a particular customer according to the customer's weight and cushioning preference. Thus, a lightweight person will in general require an insert 10 that is more cushionable and less resilient than a heavier person. Further, the customer may have a particular preference concerning how "soft" or "hard" the shoe feels, and may select a pair of inserts 10 that match his or her preferences in this respect. Finally, there may be medical reasons for selecting a right insert 10 that has a different resiliency and cushionability than a left insert 10, and the invention will permit this selection.

Figure 4:
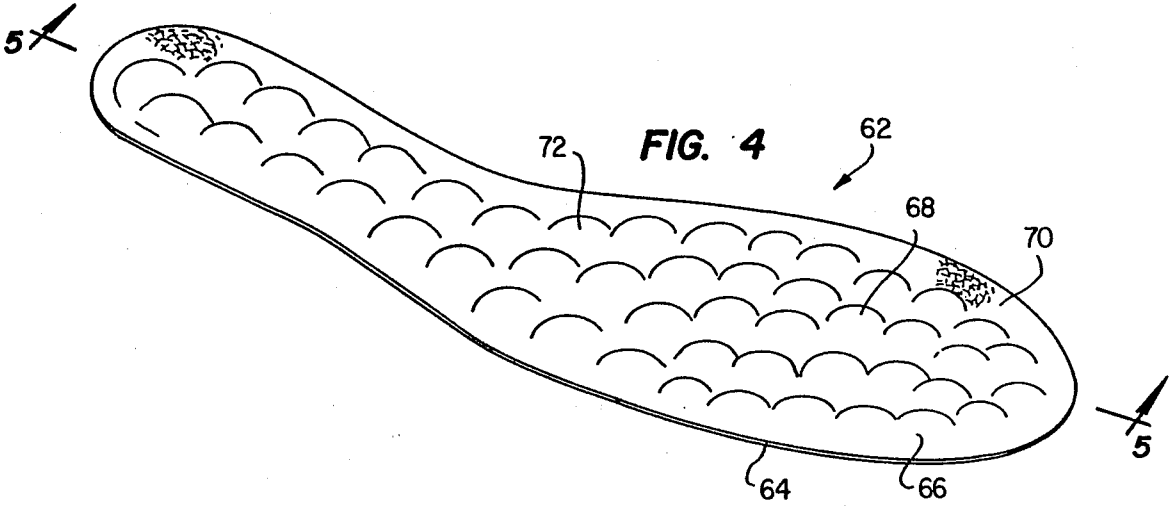
FIG. 4 is a top isometric view of an alternate embodiment of a custom midsole insert according to the invention.
Figure 5:
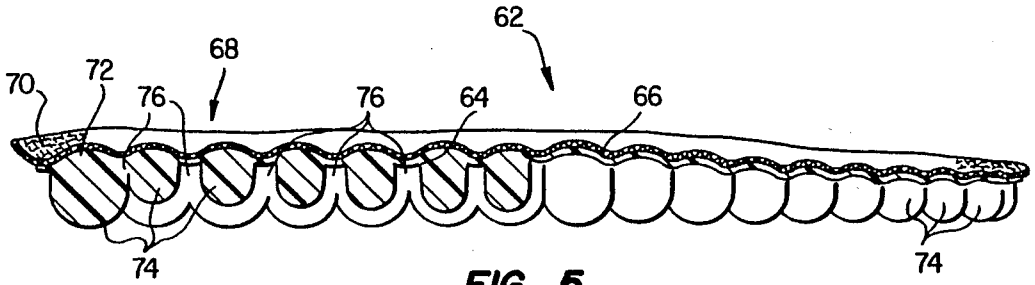
FIG. 5 is a longitudinal section taken substantially along line 5—5 of FIG. 4.

Referring now to FIGS. 4 and 5, an alternate embodiment of a custom insert according to the invention is illustrated. Referring first to FIG. 4, an alternate insert is indicated generally at 62. Like the other illustrated embodiment, insert 62 has a base member 64 to which a layer 66 of flocking material is attached as by gluing. Insert 62 comprises a central region 68 and a peripheral lip member 70 that is preferably formed integrally with region 68. The embodiments shown in FIGS. 4 and 5 differ from the insert shown in FIGS. 1–3 in that the insole portion 44 formed integrally with the first embodiment has been omitted. In its place, a plurality of convex surface elements 72 has been formed in central region 68. Convex elements 72 are provided to have a massaging effect on the lower surface of the foot of the wearer.

Referring particularly to FIG. 5, a plurality of cushioning elements 74 depend downwardly from central region 68. Like the first embodiment, elements 74 are preferably made of large size in the heel region, and are preferably made of smaller size in the toe region in order to conform to the lift of peripheral member 22. Elements 74 are joined at a middle depth 76 thereof in order to form base member 64. It is preferred that convex surfaces 72 be formed in registry with respective depending elements 74 for convenience in fabrication.

In summary, a novel midsole with a custom insert has been provided in order to vary the resiliency and cushionability of the midsole according to the wearer's needs. Two embodiments of the midsole have been provided, one with an integral insole portion and the other with a plurality of convex elements for a massaging action of the foot. Either embodiment of the midsole has a plurality of depending elements that provide an independent cushioning suspension.

While preferred embodiments of the invention and their advantages have been described above, the invention is not limited thereto but only by the spirit and scope of the claims which follow.

What is claimed is:

1. A midsole for disposal above an upper surface of an outsole comprising:

a removable insert of said midsole, a peripheral member of said midsole disposed laterally outwardly of said insert, said peripheral member forming an orifice;

a reinforcing layer joined to said upper surface of said outsole within said peripheral member and having a thickness substantially less than said peripheral member;

said insert having a base member for disposal on said peripheral member and a lower portion depending from said base member, said lower portion insertable through said orifice to make contact with said reinforcing layer;

said lower portion of said removable insert comprising a plurality of cushioning elements, said elements each operable to cushionably deform and flatten responsive to a force having a component perpendicular to said insert at said element, each element operable to deform independently of the remaining elements.

2. The midsole of claim 1, wherein said cushioning elements are radially symmetrical.

3. The midsole of claim 2, wherein said cushioning elements are approximately hemispherical in shape.

4. The midsole of claim 2, wherein said removable insert has an upper surface, a plurality of convex elements formed in said upper surface, each convex element in registry with a respective lower surface cushioning convex element.

5. The midsole of claim 2, wherein said peripheral member comprises a heel portion and a toe portion integrally formed with said heel portion, the thickness of said peripheral member decreasing from heel portion to said toe portion;

said lower portion of said insert having a front end and a rear end integrally formed with said front end, said cushioning elements each formed to be laterally adjacent a plurality of like elements in a closest-packing arrangement, each element having a radial size, the radial size of said elements decreasing from said rear end to said front end in order to effect a decrease in the thickness of said insert from said rear end to said front end.

6. The midsole of claim 2, wherein said cushioning elements are formed as pillars with rounded lower free ends.

7. The midsole of claim 1, wherein said elements are each laterally adjacent a plurality of other elements in a closest-packing arrangement.

8. The midsole of claim 1, wherein said elements are arranged in transverse rows.

9. The midsole of claim 1, wherein said peripheral member comprises a heel portion, a toe portion of said peripheral member integrally formed with said heel portion, the thickness of said peripheral member decreasing from said heel portion to said toe portion;

said portion of said insert having a rear end, a front end of said insert integrally formed with said rear end, the thickness of said insert decreasing from said rear end to said front end in correspondence with the decreasing thickness of said heel portion to said toe portion.

10. The midsole of claim 1, wherein said base member of said insert comprises a fabric layer laterally extending beyond the periphery of said insert to cover said peripheral member.

11. The midsole of claim 1, wherein said base member comprises an insole member formed above said lower portion of said insert and extending laterally to cover said peripheral member.

12. The midsole of claim 1, wherein said removable insert is formed of a cushionable synthetic material, said insert selectable from among a plurality of like inserts having different cushionabilities.

13. The midsole of claim 1, wherein said cushioning elements are convex in shape.

* * * * *